US008745905B2

(12) United States Patent
Bandow et al.

(10) Patent No.: US 8,745,905 B2
(45) Date of Patent: Jun. 10, 2014

(54) GREETING CARD HAVING INTEGRATED BUBBLE FEATURE

(76) Inventors: Brady Bandow, Columbus, OH (US); Evan Will, Columbus, OH (US)

( * ) Notice: Subject to any disclaimer, the term of this patent is extended or adjusted under 35 U.S.C. 154(b) by 0 days.

(21) Appl. No.: 13/539,469

(22) Filed: Jul. 1, 2012

(65) Prior Publication Data

US 2013/0000163 A1 Jan. 3, 2013

Related U.S. Application Data

(60) Provisional application No. 61/504,157, filed on Jul. 1, 2011.

(51) Int. Cl.
*G09F 1/00* (2006.01)
*A63H 33/28* (2006.01)

(52) U.S. Cl.
CPC ..... *A63H 33/28* (2013.01)
USPC ..... 40/124.01; 446/15

(58) Field of Classification Search
USPC ..... 40/124.01, 124.03; 446/150
See application file for complete search history.

(56) References Cited

U.S. PATENT DOCUMENTS 2,085,803 A 7/1937 Harrison
2,301,427 A * 11/1942 Lyon, Jr. ..... 446/15
2,412,732 A * 12/1946 Holman ..... 40/408
5,199,745 A 4/1993 Balsamo
5,234,726 A * 8/1993 Dahan ..... 428/9
5,263,890 A 11/1993 Dent, IV
5,289,917 A 3/1994 Chabria
5,852,889 A 12/1998 Rinaldi
6,172,658 B1 1/2001 Romberg
6,443,790 B1 * 9/2002 Cameron ..... 446/15
6,908,358 B2 * 6/2005 Lin ..... 446/16
6,978,561 B1 12/2005 Hunter
7,316,357 B2 * 1/2008 Lindahl et al. ..... 235/487
7,322,134 B2 1/2008 Cheek et al.
2004/0127137 A1 * 7/2004 Thai ..... 446/16
2007/0256337 A1 * 11/2007 Segan ..... 40/124.03
2009/0126239 A1 5/2009 Clegg
2009/0313865 A1 12/2009 Peretti et al.
2010/0287799 A1 11/2010 Clegg
2011/0078931 A1 4/2011 Sapp et al.

* cited by examiner

*Primary Examiner* — Kristina Junge

(74) *Attorney, Agent, or Firm* — Christopher H. Bond; Benesch Friedlander Coplan & Aronoff LLP

(57) ABSTRACT

Methods, systems, and apparatuses are disclosed for a greeting card having an integrated bubble feature. The greeting card may include, in one non-limiting example: a frame; an energy storage device; a switch mechanism; a motor operatively connected to each of the energy storage device and the switch mechanism; a fan operatively connected to the motor; and a bubble forming substrate.

19 Claims, 11 Drawing Sheets

Cross Section of Push Button

GREETING CARD HAVING INTEGRATED BUBBLE FEATURE

CROSS-REFERENCE TO RELATED APPLICATIONS

This application claims priority from U.S. Provisional Patent Application No. 61/504,157, filed on Jul. 1, 2011, which is incorporated by reference herein in its entirety.

BACKGROUND

In today's era of technology, the consuming public constantly expects to be entertained in new and creative ways. One such good that appeals to a consumer's interest in gadgets is the greeting card. Greeting cards have evolved past a simple piece of folded cardstock with a witty or kind saying. Many greeting cards include interactive elements such as "Scratch and Sniff" sections, confetti, and panels that move upon opening. Additionally, greeting card technology has evolved to include electronics, such as cards that play audio clips or music upon opening.

However, the interactive aspects of greeting cards have thus far not included the generation of three-dimensional objects. What is needed is a greeting card capable of entertaining consumers with a novel bubble generator contained within the card.

SUMMARY

In one embodiment, a greeting card is provided, the greeting card comprising: a frame, an energy storage device, a switch mechanism, a motor operatively connected to each of the energy storage device and the switch mechanism, a fan operatively connected to the motor, and a bubble forming substrate.

In another embodiment, a greeting card is provided, the greeting card comprising: a frame, a tube configured to transport a bubble solution, a solution container, and a bubble forming substrate.

In another embodiment, a greeting card is provided, the greeting card comprising: a frame, a tube configured to transport a bubble solution, a fan, a bubble forming substrate, a solution container, and a spring device operatively connected to the fan.

BRIEF DESCRIPTION OF THE DRAWINGS

The accompanying figures, which are incorporated in and constitute a part of the specification, illustrate various example systems, methods, and results, and are used merely to illustrate various example embodiments.

DETAILED DESCRIPTION

Card Featuring Automated Bubble Feature

Figure 1:
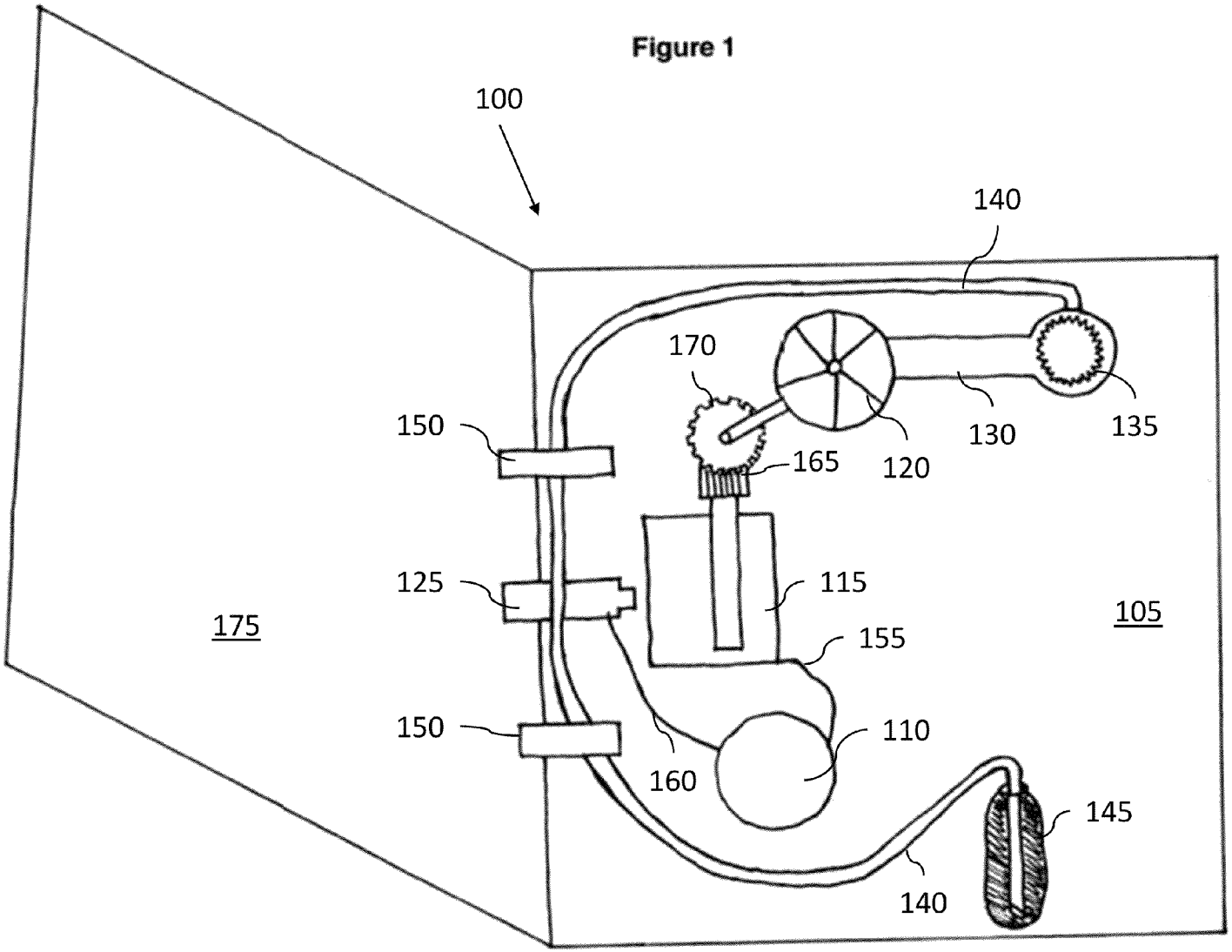
FIG. 1 illustrates an example arrangement of a greeting card having an integrated bubble feature.

FIG. 1 illustrates one embodiment of an example arrangement of a greeting card having an integrated bubble feature. It should be noted that while specific embodiments of the invention reference a greeting card, the invention may extend to any novelty item that may include the use of a bubble generation feature, including without limitation gift boxes, product packaging, and toys. Greeting card 100 includes a frame 105, an energy storage device 110, a motor 115, a fan 120, a switch mechanism 125, an air shaft 130, and a bubble forming substrate 135. In one embodiment, motor 115 is operatively connected to each of energy storage device 110 and switch mechanism 125. Greeting card 100 additionally includes a tube 140 configured to transport a bubble solution. Tube 140 is operatively connected to a solution container 145. Card 100 may further include at least one pressure clasp 150 operatively connected to tube 140.

The bubble solution may be any commercially available bubble solution. Alternatively, the bubble solution may be any solution having the appropriate surface tension to permit the forming of bubbles.

Frame 105 is any structure capable of supporting the various elements of the invention. Frame 105 may be a substrate. In one embodiment, frame 105 is a portion of or all of a greeting card, a gift box, product packaging, or a toy. In another embodiment, frame 105 is an independent structure configured to work in conjunction with a greeting card, a gift box, product packaging, or a toy, and configured to be added to an existing product. In one embodiment, frame 105 forms a base to which is mounted one or more of the various components of greeting card 100, as described below.

Energy storage device 110 may be any device capable of storing energy to run a motor. In one embodiment, energy storage device 110 is a battery, for example, a 3 Volt coin-sized battery. In another embodiment, energy storage device 110 is a capacitor. In still another embodiment, energy storage device 110 is any device capable of generating energy, for example, an engine, a generator, or a photovoltaic module. In one embodiment, energy storage device 110 is operatively connected to motor 115 and switch mechanism 125. In another embodiment, energy storage device 110 is operatively connected to motor 115 by a wire 155. In another embodiment, energy storage device 110 is operatively connected to switch mechanism 125 by a wire 160. Wires 155 and 160 can be any wire capable of carrying electrical current.

Motor 115 may be any electric motor configured to convert electrical energy into mechanical energy. In one embodiment, motor 115 is an electric motor configured to convert electrical energy into rotation of an output shaft 165. Output shaft 165 may include a gear configured to engage an input shaft 170, which is operatively connected to fan 120. Input shaft 170 may include a gear configured to engage the gear on output shaft 165. Motor 115 is operatively connected to fan 120 and configured to cause fan 120 to rotate. Output shaft 165 and input shaft 170 may include circular gears.

Fan 120 may be any bladed fan configured to move air. In another embodiment, fan 120 may be any apparatus configured to create air pressure, for example, a pump. Fan 120 can be capable of rotating at any desired velocity to generate the appropriate rate, velocity, and pressure of air interacting with bubble forming substrate 135. The velocity of fan 120's rotation may be controlled by one or more of: the gear ratio of output shaft 165 and input shaft 170, the rotational speed of motor 115, the voltage supplied by energy storage device 110, and voltage regulated by use of a potentiometer (not shown). Fan 120 may be formed of any material, including without limitation, a polymer, a metal, an alloy, a composite, paper, or cardboard.

Switch mechanism 125 may include any mechanism capable of selectively creating and breaking a circuit, such that a current may flow or be stopped, respectively. Switch mechanism 125 is operatively connected to energy storage device 110 and motor 115. In one embodiment, switch mechanism 125 is connected to at least one of energy storage device 110 and motor 115 by a wire. In another embodiment, switch mechanism 125 is directly connected to at least one of energy storage device 110 and motor 115. In yet another embodiment, switch mechanism 125 is an integral part of at least one of energy storage device 110 and motor 115. In one embodiment, frame 105 includes a cover portion 175 configured to hinge such that it may open and close. Switch mechanism 125 may be operatively connected and manipulated by cover portion 175, such that opening and closing of cover portion 175 manipulates switch mechanism 125. In one embodiment, switch mechanism 175 is at least partially connected to cover 175. In one embodiment, opening cover portion 175 causes switch mechanism 125 to create a circuit, thereby allowing a current to flow between energy storage device 110 and motor 115. Closing cover portion 175 may cause switch mechanism 125 to break a circuit, thereby stopping the flow of a current between energy storage device 110 and motor 115. In another embodiment, switch mechanism 125 is configured to be manually operated by a user of greeting card 100. Switch mechanism 125 may include a lever, slide plate, button, or any other manual means of activating switch mechanism 125 by a user. In one embodiment, switch mechanism 125 is configured such that it can be manually placed in an "on" or "off" position by a user, and will remain in such position until a user places it in another position. In another embodiment, switch mechanism 125 is configured such that a user places it in an "on" position through force, but upon removal of such force switch mechanism 125 automatically returns to an "off" position. In another embodiment, switch mechanism 125 is activated by exposure to a light source. Switch mechanism 125 may include a photocell and/or a photoresistor configured to create a circuit upon exposure to a light source. In another embodiment, switch mechanism 125 is activated or deactivated by a combination of any of the above structures and methods.

Air shaft 130 may be operatively connected to at least one of fan 120 and bubble forming substrate 135. In another embodiment, air shaft 130 is operatively connected to each of fan 120 and bubble forming substrate 135. Air shaft 130 is configured to guide air moved by fan 120 to the vicinity of bubble forming substrate 135. Air shaft 130 may include a channel and/or a tunnel configured to contain the stream of air from fan 120. In one embodiment, air shaft 130 may be eliminated and fan 120 may be placed in appropriate proximity to bubble forming substrate 135 such that bubbles may be formed on bubble forming substrate 135. Air shaft 130 may be formed of any material, including without limitation, a polymer, a metal, an alloy, a composite, paper, or cardboard.

Bubble forming substrate 135 may be configured to receive a stream of air generated by fan 120 and/or transported by air shaft 130. Bubble forming substrate may have any of a variety of shapes, for example, a ring. Bubble forming substrate 135 may comprise a hollow portion and ports configured to evenly distribute a bubble solution transported by tube 140. In one embodiment, bubble forming substrate 135 is in the shape of a ring and includes a plurality of teeth formed along its interior surface, wherein the plurality of teeth are configured to at least substantially retain a bubble solution. In one embodiment, bubble forming substrate 135 is a ring and is configured such that the air stream generated by fan 120 crosses through the interior of the ring and at least substantially contacts a plurality of teeth formed along the ring's interior surface. The stream of air generated by fan 120 contacts bubble solution retained in the plurality of teeth formed along the interior surface of the ring and causes at least one bubble to be formed. Bubble forming substrate 135 may be formed of any material, including without limitation, a polymer, a metal, an alloy, a composite, paper, or cardboard.

Tube 140 may operatively connect solution container 145 to bubble forming substrate 135. In one embodiment, tube 140 is operatively connected to at least one pressure clasp 150, which is configured to apply pressure to tube 140 or remove pressure from tube 140 and cause bubble solution to progress from solution container 145 to bubble forming substrate 135. In one embodiment, the at least one pressure clasp 150 is operatively connected to cover 175 such that upon opening the cover, the at least one pressure clasp 150 is configured to interact with tube 140 and permit flow of bubble solution from sample container 145 to bubble forming substrate 135. In another embodiment, tube 140 is operatively connected to at least one circular gear (not shown), which is operatively connected to motor 115. The circular gear is configured to rotate upon activation of motor 115 and provide pressure to tube 140 or remove pressure from tube 140 and cause bubble solution to progress from solution container 145 to bubble forming substrate 135. Tube 140 may be formed of any material, including without limitation, rubber, a polymer, a metal, an alloy, and a composite.

Solution container 145 is configured to contain bubble solution until the bubble solution is transported to bubble forming substrate 135 by tube 140. In one embodiment, solution container 145 is selectively sealed such that a gas or liquid cannot pass into or from the solution container until a user permits the gas or liquid to pass into or from the solution container. Solution container 145 may be sealed such that bubble solution contained therein is not able to flow into tube 140 until activation of greeting card 100. Solution container 145 may be sealed such that air is prevented from entering into solution container 145 until activation of greeting card 100, such that bubble solution is not contaminated or caused to dry out. In another embodiment, solution container 145, in conjunction with tube 140, comprises a sealed unit capped by pressure placed on tube 140 by at least one of pressure clasp 150 or a circular gear (not shown). In one embodiment, solution container 145 is sealed with an internal pressure greater than atmospheric pressure, such that upon activation of greeting card 100, the seal in solution container 145 is broken and bubble solution contained therein is permitted to flow into tube 140 under a pressure greater than atmospheric pressure. In one embodiment, solution container 145 is sealed until a user applies pressure to solution container 145, for example, by squeezing solution container 145. This same application of pressure by a user may additionally cause bubble solution to be forced from solution container 145, into tube 140, and ultimately to bubble forming substrate 135. In another embodiment, solution container 145 is pressurized and sealed until a user removes the seal from solution container 145, for example by pulling a string attached to the seal which allows bubble solution to travel from solution container 145, into tube 140 and ultimately to bubble forming substrate 135. Such string may also be pulled automatically upon opening of the card. Solution container 145 may be formed of any material, including without limitation, rubber, a polymer, a metal, an alloy, and a composite.

At least one pressure clasp 150 is configured to interact with tube 140 and permit flow of bubble solution from sample container 145 to bubble forming substrate 135. In another embodiment, at least one pressure clasp 150 is directly attached to cover 175 and configured such that opening of cover 175 manipulates at least one pressure clasp 150 such that it interacts with tube 140 and permits flow of bubble solution. At least one pressure clasp 150 may be formed of any material, including without limitation, rubber, a polymer, a metal, an alloy, and a composite.

As illustrated in FIG. 1, greeting card 100 is configured such that when cover 175 is opened switch mechanism 125 is activated and creates a circuit between energy storage device 110 and motor 115. At least substantially simultaneous to this action, at least one pressure clasp 150 is manipulated upon opening of cover 175, such that at least one pressure clasp 150 interacts with tube 140 and causes bubble solution to flow from solution container 145, through tube 140 and into bubble forming substrate 135. Motor 115, having been activated upon completion of the circuit between motor 115 and energy storage device 110, turns geared output shaft 165, which interacts with geared input shaft 170, thus causing input shaft 170 to rotate. Rotation of input shaft 170 causes fan 120 to rotate, creating a stream of air channeled through air shaft 130 to bubble forming substrate 135. The bubble solution contained in teeth formed on the interior surface of the bubble forming substrate 135's ring interacts with the stream of air produced by fan 120 and creates at least one bubble. In one embodiment, a plurality of bubbles are formed and projected away from greeting card 100 by the stream of air produced by fan 120.

Figure 2:
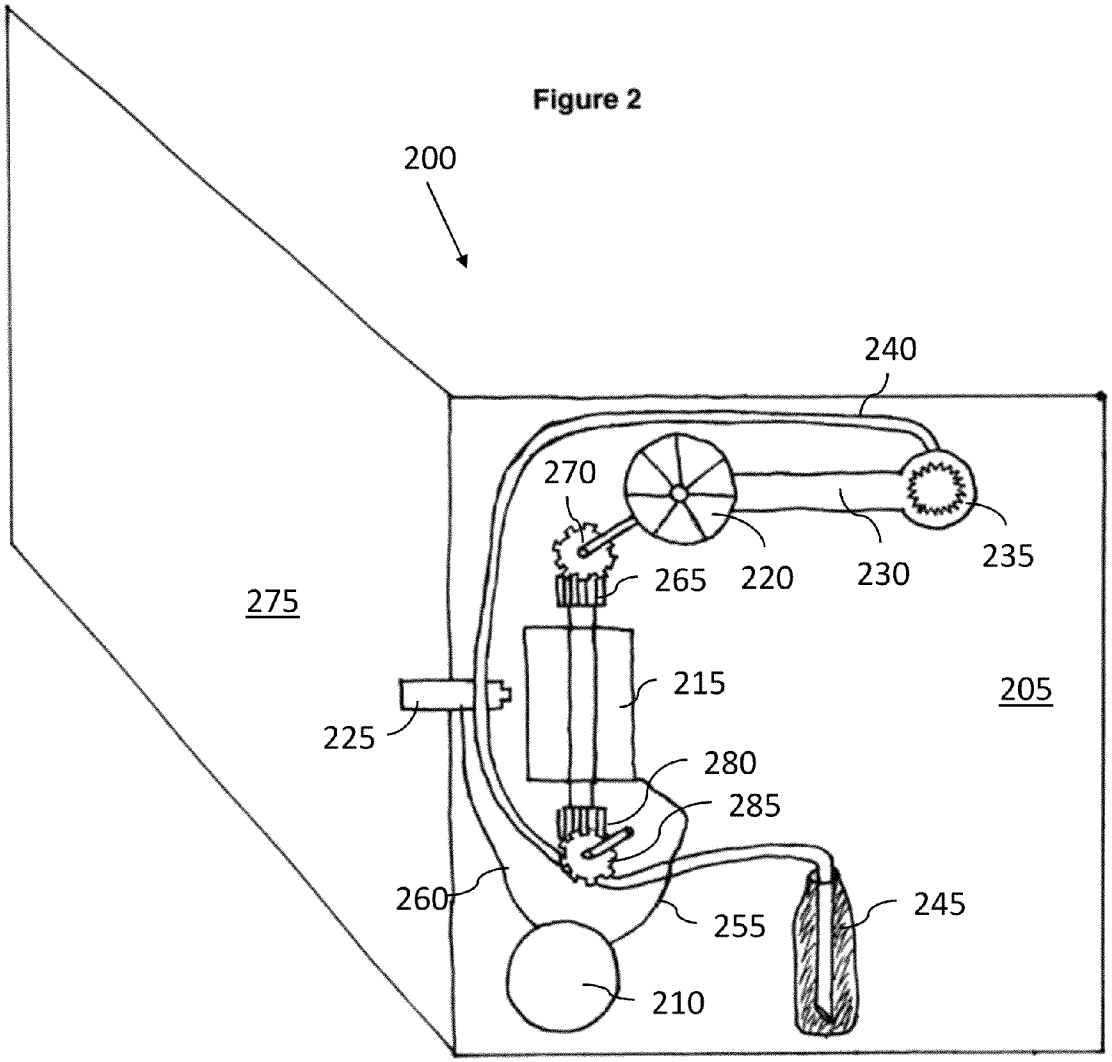
FIG. 2 illustrates another example arrangement of a greeting card having an integrated bubble feature.

FIG. 2 illustrates another embodiment of an example arrangement of a greeting card having an integrated bubble feature. Greeting card 200 includes a frame 205, an energy storage device 210, a motor 215, a fan 220, a switch mechanism 225, an air shaft 230, and a bubble forming substrate 235. In one embodiment, motor 215 is operatively connected to each of energy storage device 210 and switch mechanism 225. Greeting card 200 additionally includes a tube 240 configured to transport a bubble solution from a solution container 245 to bubble forming substrate 235. Energy storage device 210 is connected to motor 215 by wire 255, and is connected to switch mechanism 225 by wire 260. Motor 215 includes an output shaft 265 having a gear that interacts with geared input shaft 270. Frame 205 includes a cover 275. In one embodiment, motor 215 comprises a second geared output shaft 280. Output shaft 280 engages at least one circular gear 285, which is operatively connected to tube 240. Output shaft 280 causes at least one circular gear 285 to rotate upon activation of motor 215. Rotation of at least one circular gear 285 causes at least one circular gear 285 to interact with tube 240, thereby causing bubble solution to flow from solution container 245, through tube 240 and into bubble forming substrate 235.

Figure 3:
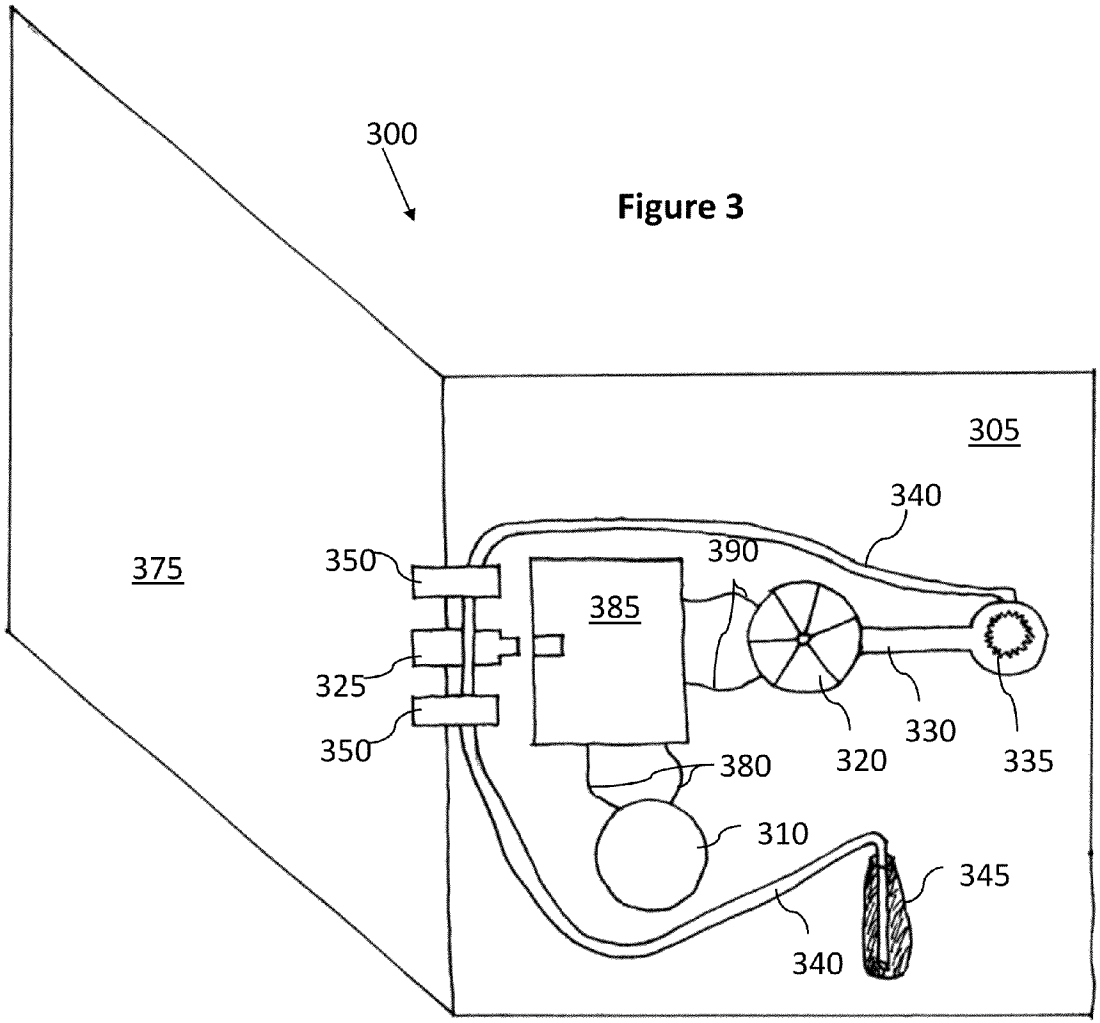
FIG. 3 illustrates another example arrangement of a greeting card having an integrated bubble feature.

FIG. 3 illustrates another embodiment of an example arrangement of a greeting card having an integrated bubble feature. Greeting card 300 includes a frame 305, an energy storage device 310, a fan 320, a switch mechanism 325, an air shaft 330, and a bubble forming substrate 335. Greeting card 300 additionally includes a tube 340 configured to transport a bubble solution from a solution container 345 to bubble forming substrate 335. At least one pressure clasp 350 is operatively connected to tube 340, such that it interacts with tube 340 and permits flow of bubble solution. In one embodiment, frame 305 includes a cover 375, which may be operatively connected to both switch mechanism 325 and at least one pressure clasp 350, thereby causing manipulation of switch mechanism 325 and at least one pressure clasp 350 upon opening and closing of cover 375. As illustrated in FIG. 3, energy storage device 310 is connected via wires 380 to a circuit board 385, which is operatively connected to fan 320 via wires 390. In this embodiment, fan 320 includes an integrated motor unit (not shown).

Circuit board 385 is operatively connected to switch mechanism 325. In one embodiment, opening of cover 375 causes manipulation of switch mechanism 325, such that switch mechanism 325 interacts with circuit board 385, which controls the electrical current to fan 320. In another embodiment, user manipulation of switch mechanism 325 causes switch mechanism 325 to interact with circuit board 385, which controls the electrical current to fan 320.

Figure 4:
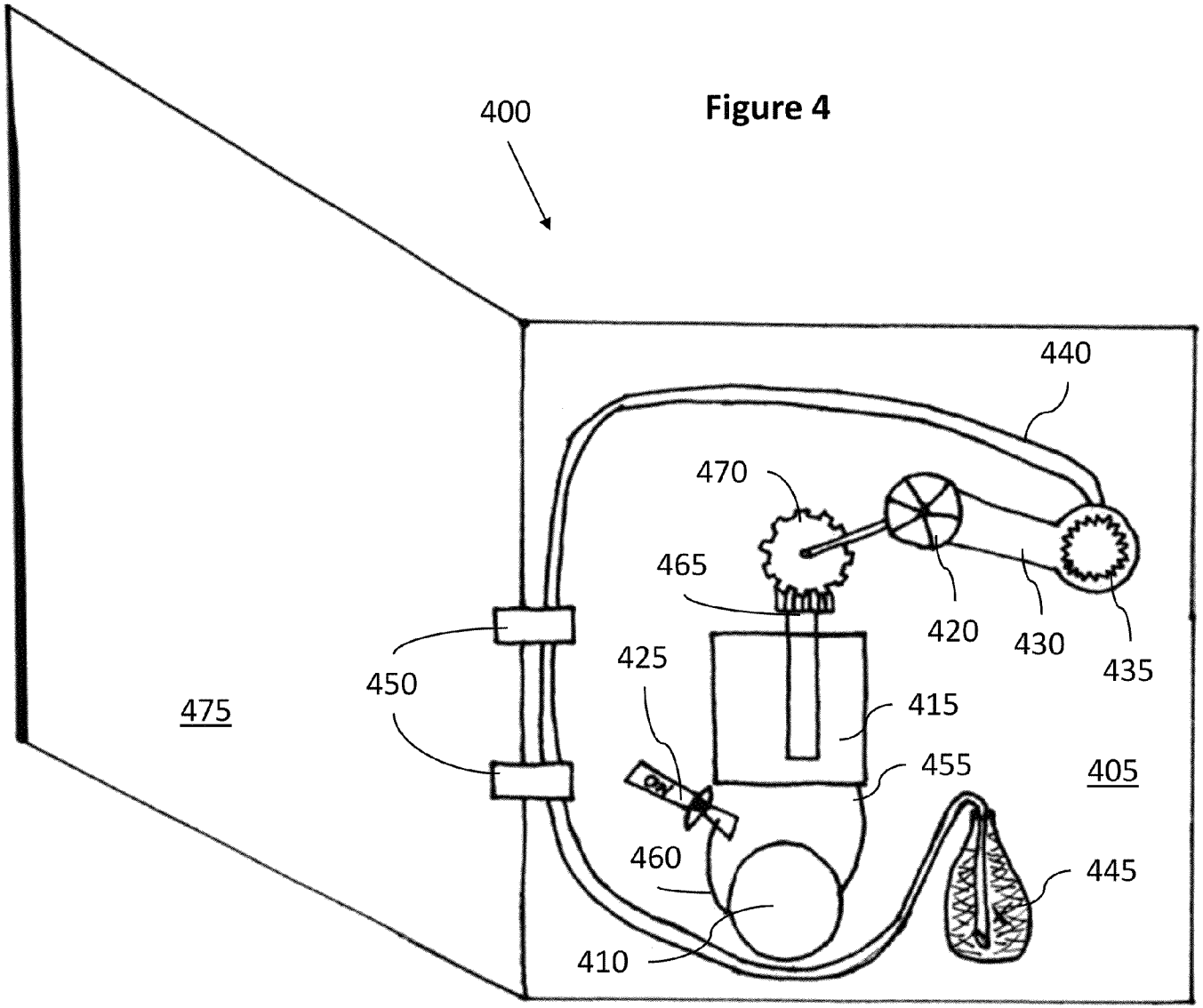
FIG. 4 illustrates another example arrangement of a greeting card having an integrated bubble feature.

FIG. 4 illustrates another embodiment of an example arrangement of a greeting card having an integrated bubble feature. Greeting card 400 includes a frame 405, an energy storage device 410, a motor 415, a fan 420, a switch mechanism 425, an air shaft 430, and a bubble forming substrate 435. In one embodiment, motor 415 is operatively connected to each of energy storage device 410 and switch mechanism 425. In the embodiment illustrated in FIG. 4, switch mechanism 425 is configured such that it is manually manipulated by a user, wherein the manual manipulation of switch mechanism 425 causes it to contact motor 415, thereby completing an electrical circuit and activating motor 415. Similarly, in one embodiment, switch mechanism 425 is manually manipulated such that its contact with motor 415 is broken, thereby breaking an electrical circuit, and deactivating motor 415. Greeting card 400 additionally includes a tube 440 configured to transport a bubble solution from a solution container 445 to bubble forming substrate 435. Greeting card 400 may additionally include at least one pressure clasp 450 is configured to interact with tube 440 and permit flow of bubble solution from sample container 445 to bubble forming substrate 435. Energy storage device 410 is connected to motor 415 by wire 455, and is connected to switch mechanism 425 by wire 460. Motor 415 includes an output shaft 465 having a gear that interacts with geared input shaft 470. Frame 405 includes a cover 475.

Figure 5:
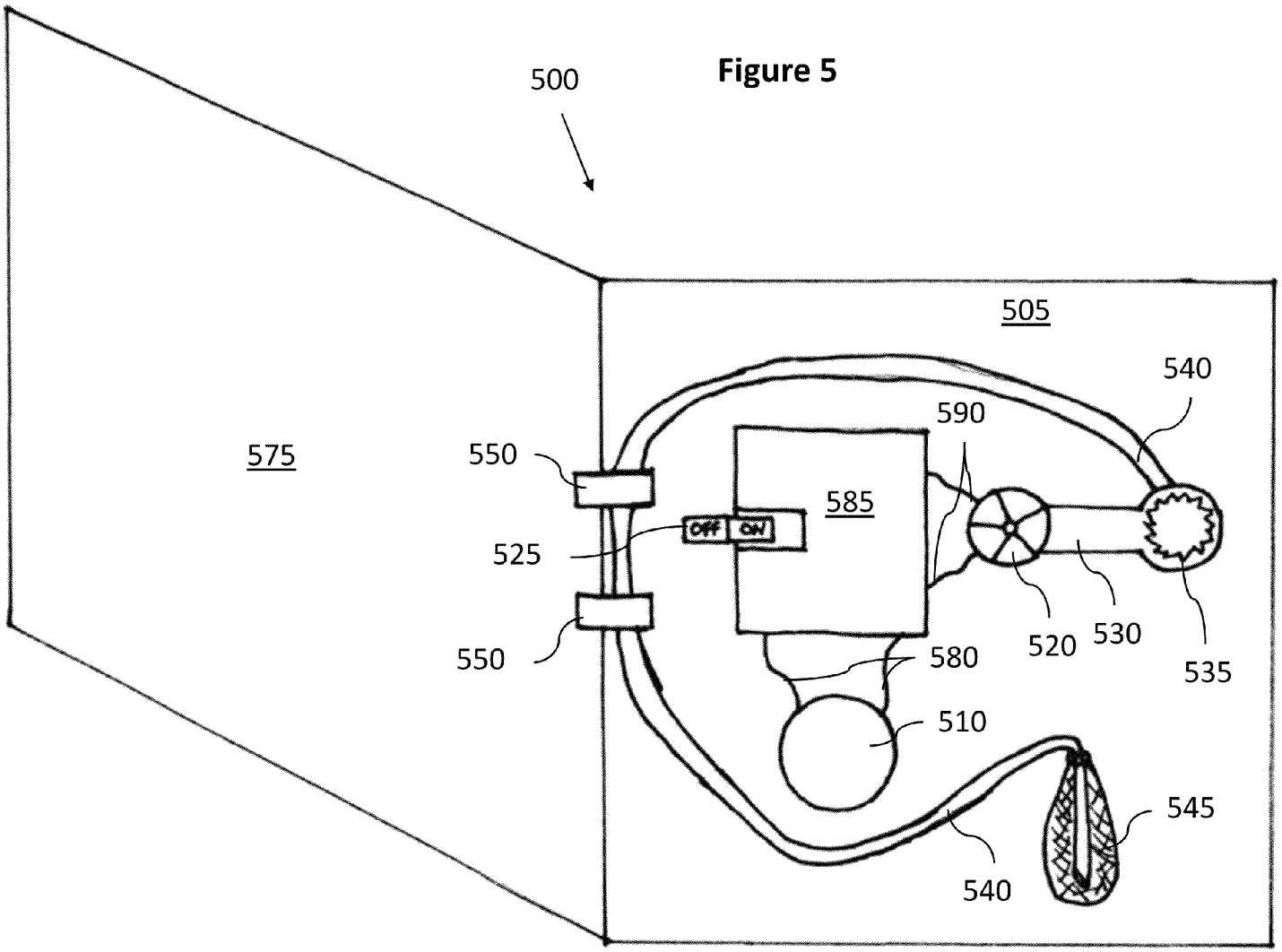
FIG. 5 illustrates another example arrangement of a greeting card having an integrated bubble feature.

FIG. 5 illustrates another embodiment of an example arrangement of a greeting card having an integrated bubble feature. Greeting card 500 includes a frame 505, an energy storage device 510, a fan 520, a switch mechanism 525, an air shaft 530, and a bubble forming substrate 535. Greeting card 500 additionally includes a tube 540 configured to transport a bubble solution from a solution container 545 to bubble forming substrate 535. At least one pressure clasp 550 is operatively connected to tube 540, such that it interacts with tube 540 and permits flow of bubble solution. In one embodiment, frame 505 includes a cover 575, which may be operatively connected to at least one pressure clasp 550, thereby causing manipulation of at least one pressure clasp 550 upon opening and closing of cover 575. As illustrated in FIG. 5, energy storage device 510 is connected via wires 580 to a circuit board 585, which is operatively connected to fan 520 via wires 590. In this embodiment, fan 520 includes an integrated motor unit (not shown). Switch mechanism 525 is configured such that it is manually manipulated by a user, wherein the manual manipulation of switch mechanism 525 causes it to contact circuit board 585, thereby completing an electrical circuit, and activating fan 520. Similarly, in one embodiment, switch mechanism 525 is manually manipulated such that its contact with circuit board 585 is broken, thereby breaking an electrical circuit, and deactivating fan 520.

Figure 6A:
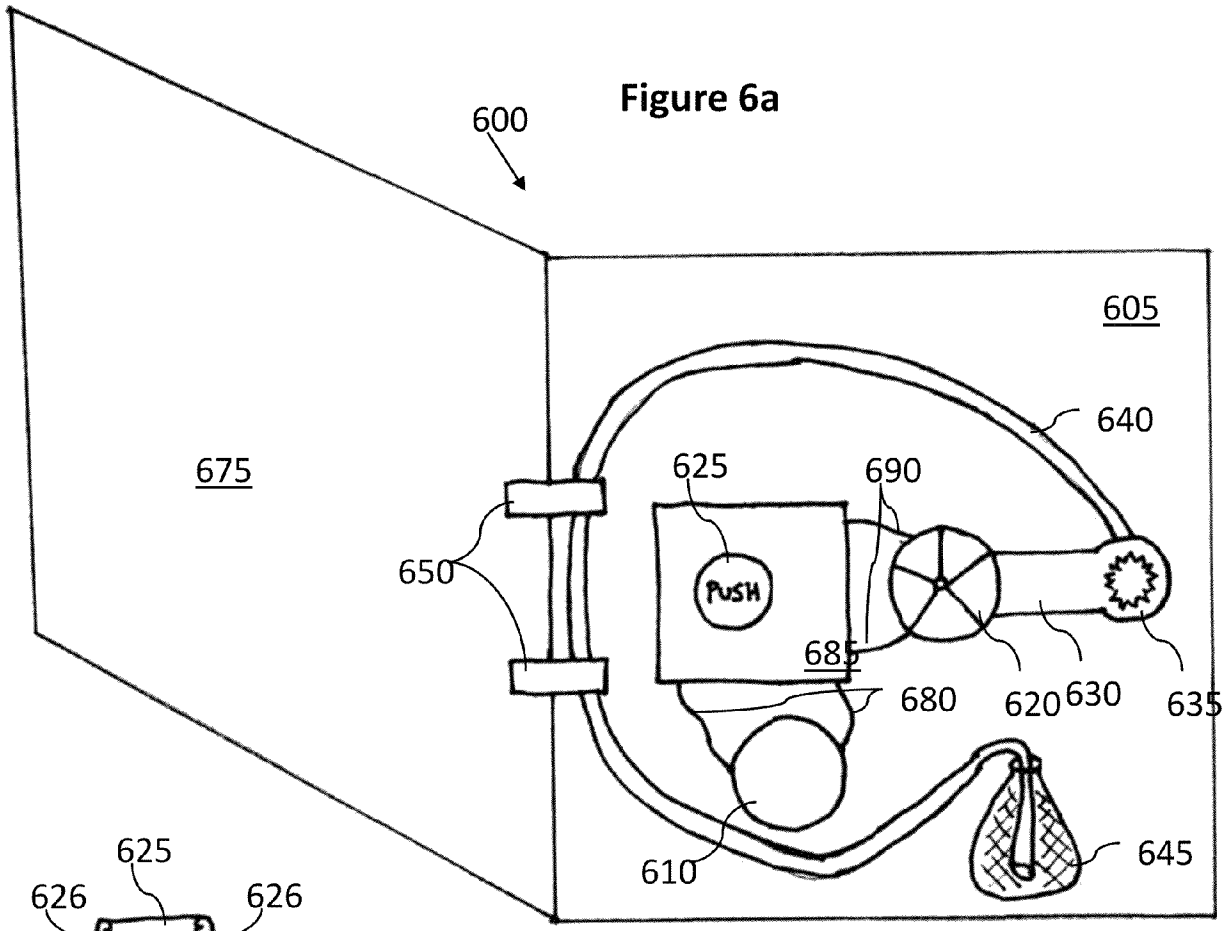
FIG. 6*a* illustrates another example arrangement of a greeting card having an integrated bubble feature.

FIG. 6*a* illustrates another embodiment of an example arrangement of a greeting card having an integrated bubble feature. Greeting card 600 includes a frame 605, an energy storage device 610, a fan 620, a switch mechanism 625, an air shaft 630, and a bubble forming substrate 635. Greeting card 600 additionally includes a tube 640 configured to transport a bubble solution from a solution container 645 to bubble forming substrate 635. At least one pressure clasp 650 is operatively connected to tube 640, such that it interacts with tube 640 and permits flow of bubble solution. In one embodiment, frame 605 includes a cover 675, which may be operatively connected to at least one pressure clasp 650, thereby causing manipulation of at least one pressure clasp 650 upon opening and closing of cover 675. As illustrated in FIG. 6*a*, energy storage device 610 is connected via wires 680 to a circuit board 685, which is operatively connected to fan 620 via wires 690. In this embodiment, fan 620 includes an integrated motor unit (not shown). Switch mechanism 625 is configured as a push button such that it is manually manipulated by a user, wherein the manual manipulation of switch mechanism 625 causes it to contact circuit board 685, thereby completing an electrical circuit, and activating fan 620. Similarly, in one embodiment, switch mechanism 625 is configured such that upon release of switch mechanism 625, its contact with circuit board 685 is automatically broken, thereby breaking an electrical circuit, and deactivating fan 620.

Figure 6B:
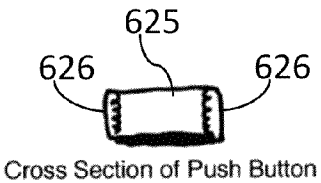
FIG. 6*b* illustrates a switch for use in greeting card having an integrated bubble feature.

FIG. 6*b* illustrates a side cross-sectional view of switch mechanism 625. Switch mechanism 625 may include a plurality of spring components 626 configured to bias switch mechanism 625 in an "off" position, wherein the electrical circuit is broken. In this embodiment, a user depresses switch mechanism 625 and creates a complete electrical circuit, resulting in activation of the fan and generation of bubbles. Upon the user releasing switch mechanism 625, springs 626 cause switch mechanism 625 to return to its original position, resulting in deactivation of the fan and discontinuation of the generation of bubbles.

Figure 7:
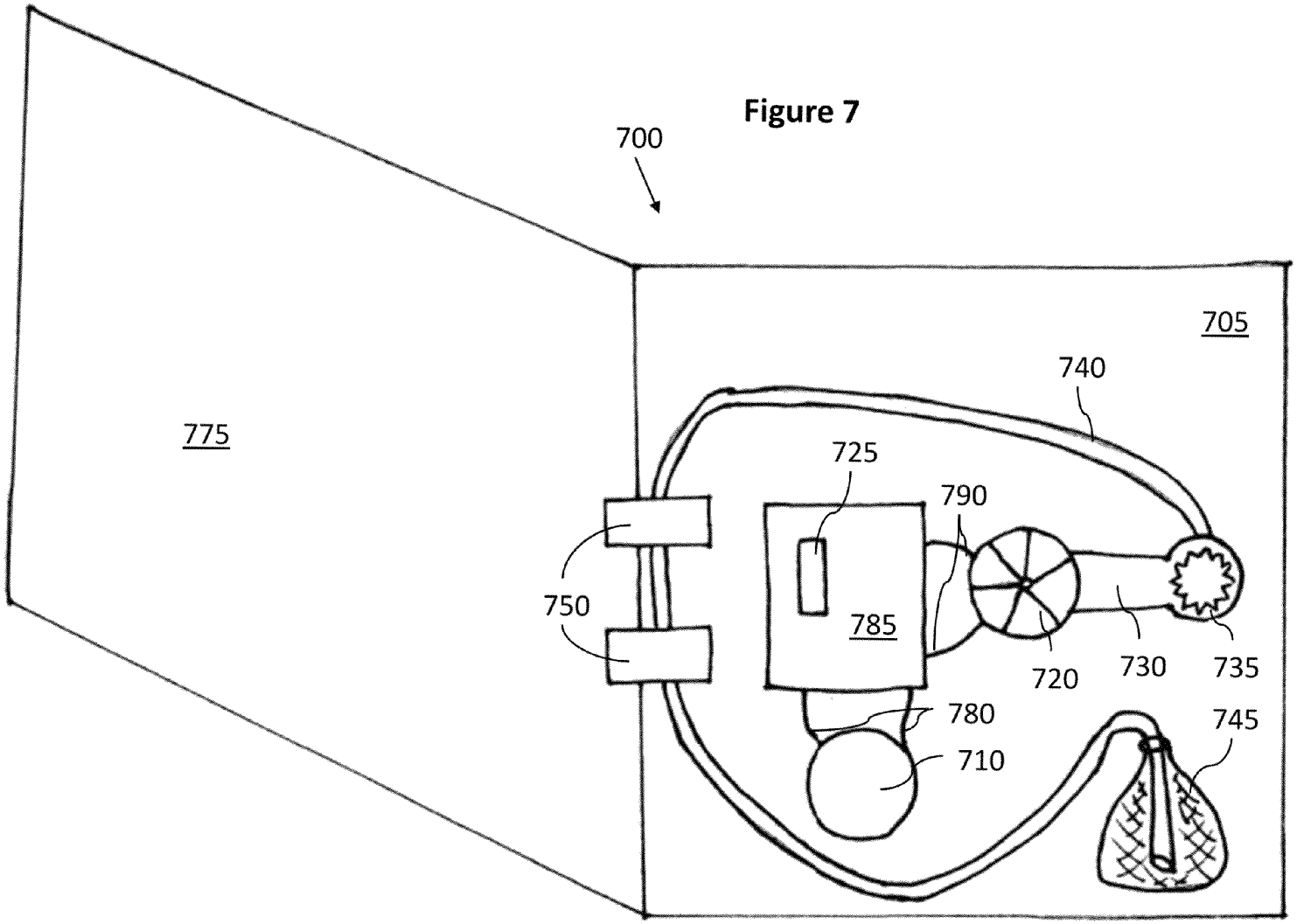
FIG. 7 illustrates another example arrangement of a greeting card having an integrated bubble feature.

FIG. 7 illustrates another embodiment of an example arrangement of a greeting card having an integrated bubble feature. Greeting card 700 includes a frame 705, an energy storage device 710, a fan 720, a switch mechanism 725, an air shaft 730, and a bubble forming substrate 735. Greeting card 700 additionally includes a tube 740 configured to transport a bubble solution from a solution container 745 to bubble forming substrate 735. At least one pressure clasp 750 is operatively connected to tube 740, such that it interacts with tube 740 and permits flow of bubble solution. In one embodiment, frame 705 additionally includes a cover 775, which may be operatively connected to at least one pressure clasp 750, thereby causing manipulation of at least one pressure clasp 750 upon opening and closing of cover 775. As illustrated in FIG. 7, energy storage device 710 is connected via wires 780 to a circuit board 785, which is operatively connected to fan 720 via wires 790. In this embodiment, fan 720 includes an integrated motor unit (not shown). In one embodiment, switch mechanism 725 includes a photocell configured to complete an electrical circuit upon exposure to a light source, thereby causing current to flow from energy storage device 710, through circuit board 785, and into fan 720. Similarly, in one embodiment, switch mechanism 725 includes a photocell and is configured such that upon removal from a light source, an electrical circuit is broken, thereby deactivating fan 720.

Figure 8:
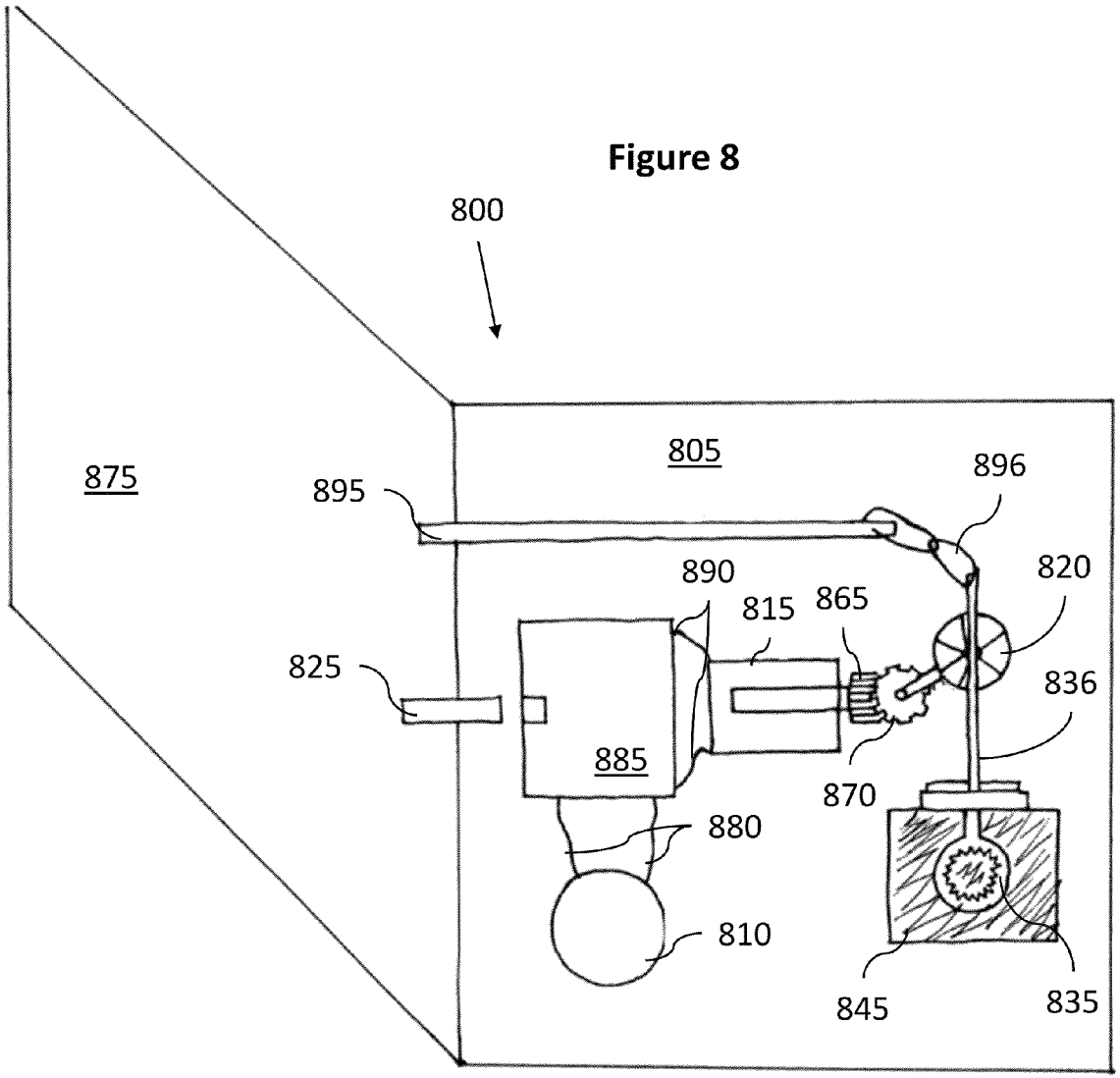
FIG. 8 illustrates another example arrangement of a greeting card having an integrated bubble feature.

FIG. 8 illustrates another embodiment of an example arrangement of a greeting card having an integrated bubble feature. Greeting card 800 includes a frame 805, an energy storage device 810, a motor 815, a fan 820, a switch mechanism 825, and a bubble forming substrate 835. Bubble forming substrate 835 includes an elongated base member 836. Greeting card 800 additionally includes a solution container 845 configured to contain bubble forming substrate 835. Motor 815 includes an output shaft 865 having a gear that interacts with geared input shaft 870, which is operatively connected to fan 820. Output shaft 865 and input shaft 870 are configured such that rotation of motor 815 causes output shaft 865 to rotate, which in turn causes input shaft 870 to rotate, resulting in rotation of fan 820. Frame 805 includes a cover 875. Energy storage device 810 is connected via wires 880 to a circuit board 885, which is operatively connected to motor 815 via wires 890. In one embodiment, switch mechanism 825 is operatively connected to cover 875 and circuit board 885, such that manipulation of cover 875 causes manipulation of switch mechanism 825, resulting in completion of a an electrical circuit. The completion of the electrical circuit allows electricity from energy storage device 810 to travel through circuit board 885 and into motor 815.

Greeting card 800 additionally includes an elongated arm member 895, operatively connected to cover 875 at one end, and a lever 896 at its other end. In one embodiment, arm member 895 is operatively connected to each of bubble forming substrate 835 and frame 805. Upon manipulation of cover 875, for example, opening cover 875, arm member 895 is actuated such that lever 896 pivots about a fixed point (not shown). Lever 896 is operatively connected to elongated base member 836. Pivot of lever 896 results in elongated base member 836 and bubble forming substrate 835 to be actuated. Actuation of bubble forming substrate 835 results in removal of bubble forming substrate from solution container 845, and transfer of bubble forming substrate 835 to a position substantially in the path of the air stream generated by fan 820. Bubble forming substrate 835 is configured such that at least a portion of bubble solution stored in solution container 845 will be substantially retained by a plurality of teeth formed along the interior surface of bubble forming substrate 835. Said transfer of bubble forming substrate 835 from solution container 845 to a position in the path of the air stream generated by fan 820 results in the generation of bubbles.

Card Featuring Manual Bubble Feature

Figure 9:
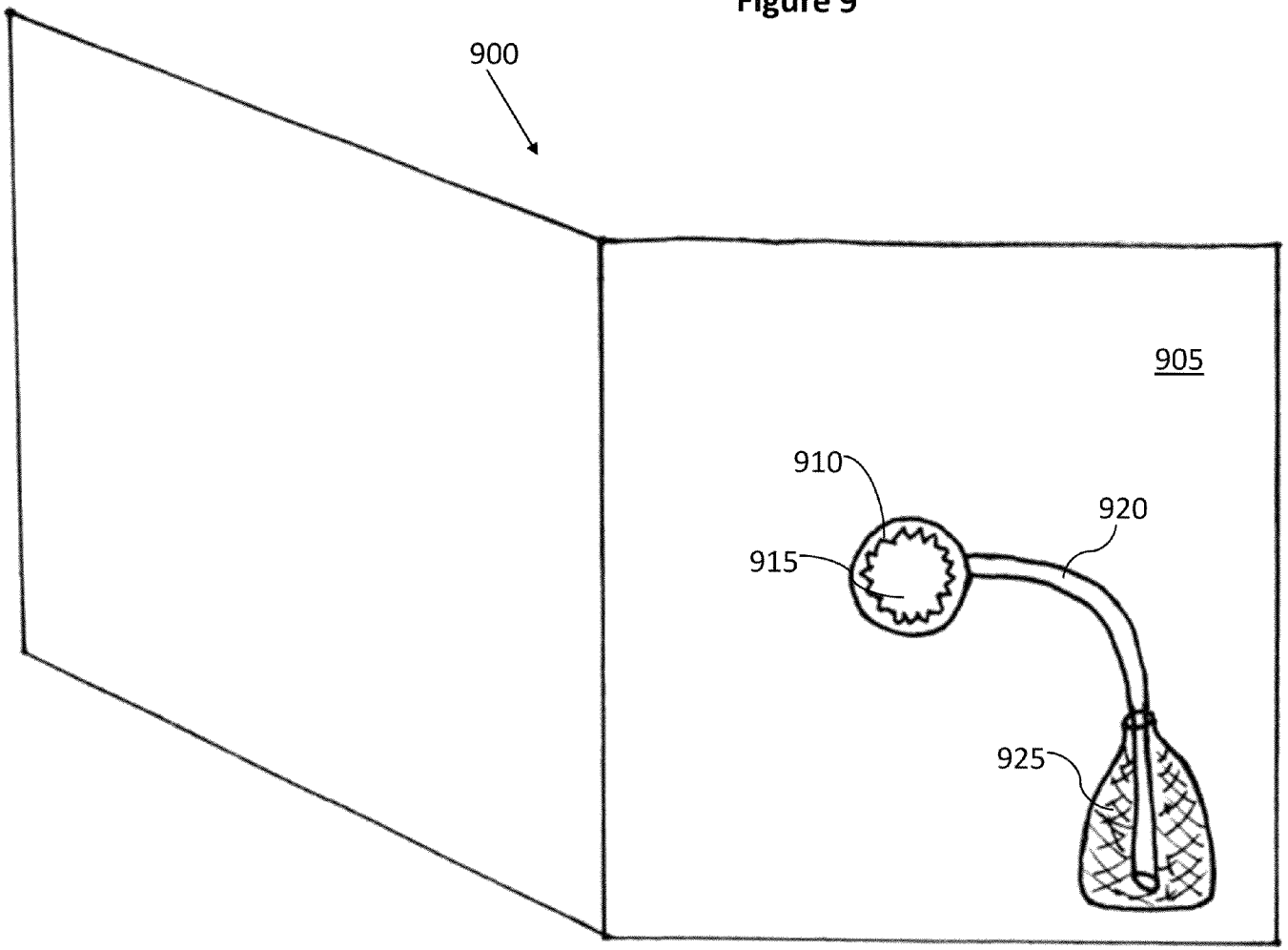
FIG. 9 illustrates another example arrangement of a greeting card having an integrated bubble feature.

FIG. 9 illustrates another embodiment of an example arrangement of a greeting card having an integrated bubble feature. It should be noted that while specific embodiments of the invention reference a greeting card, the invention may extend to any novelty item that may include the use of a bubble generation feature, including without limitation gift boxes, product packaging, and toys. Greeting card 900 includes a frame 905, a bubble forming substrate 910, an aperture 915, a tube 920, and a solution container 925.

In one embodiment, tube 920 operatively connects solution container 925 to bubble forming substrate 910. Solution container 925 may be formed of any material, including without limitation, rubber, a polymer, a metal, an alloy, and a composite. In one embodiment, solution container 925 is formed of a flexible material having a pliable structure, such as a rubber or a polymer, which permits a user to apply pressure to solution container 925, for example, by squeezing solution container 925. The application of pressure to solution container 925 may cause one or more of: breaking the seal on solution container 925, causing bubble solution to exit solution container 925, causing bubble solution to enter tube 920, and causing bubble solution to be transported to bubble forming substrate 910. In one embodiment, solution container 925 is selectively sealed such that a gas or liquid cannot pass into or from the solution container until a user permits the gas or liquid to pass into or from the solution container.

Aperture 915 may include a hole extending from an exterior surface of card 900 to bubble forming substrate 910. In one embodiment, aperture 915 extends through frame 905 from a front surface in the proximity of bubble forming substrate 910 to a back surface. In another embodiment, aperture 915 is positioned substantially within the ring of bubble forming substrate 910. Aperture 915 may be of a width such as to permit flow of an adequate volume and rate of air, such that bubbles may be formed as the air passes through bubble forming substrate 915. Aperture 915 may additionally include one or more of a mouthpiece, nozzle, check valve, cap, and plug.

In one embodiment, greeting card 900 is configured such that a user applies pressure to solution container 925, causing bubble solution to travel to bubble forming substrate 910 via tube 920. Once bubble solution is applied to bubble forming substrate 910, a user may blow air through the user's mouth, and direct the stream to pass through bubble forming substrate 910 and aperture 915, thus creating bubbles. In one embodiment, a user may blow air from a front surface of card 900, a rear surface of card 900, or both. In another embodiment, aperture 915 is eliminated, and bubble forming substrate 910 is offset from a surface of frame 905 a distance adequate to permit enough air flow through bubble forming substrate 910 to produce at least one bubble. In another embodiment, greeting card 900 is configured such that a user may cause an air stream to pass through aperture 915 and bubble forming substrate 910 using any means, for example, by placing card 900 in wind, waving card 900 through the air rapidly, and placing card 900 in front of an air stream source.

Figure 10:
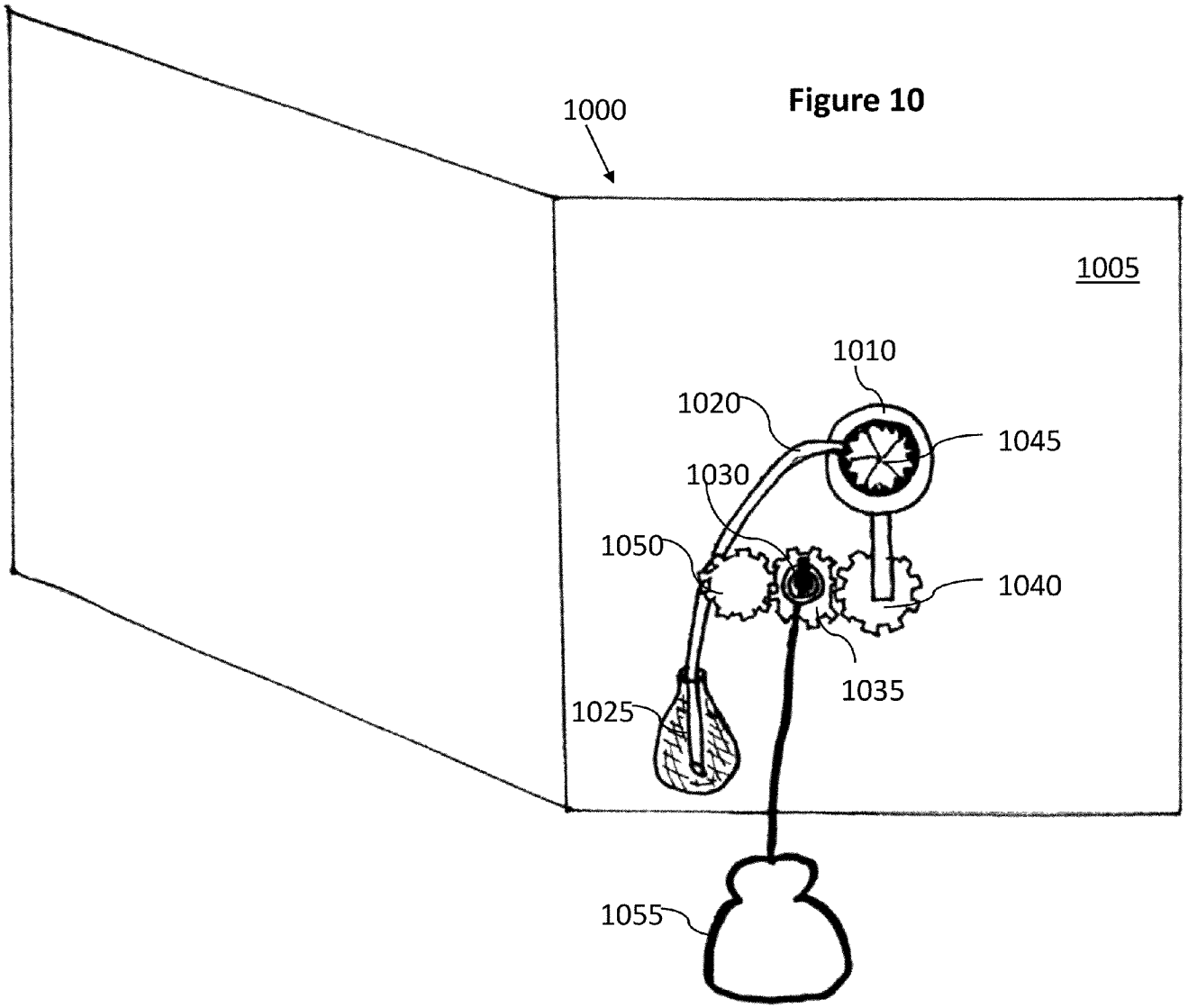
FIG. 10 illustrates another example arrangement of a greeting card having an integrated bubble feature.

FIG. 10 illustrates another embodiment of an example arrangement of a greeting card having an integrated bubble feature. Greeting card 1000 includes a frame 1005, a bubble forming substrate 1010, and a tube 1020 operatively connected to bubble forming substrate 1010 and a solution container 1025. Tube 1020 may be configured to transport a bubble solution from solution container 1025 to bubble forming substrate 1010. In one embodiment, solution container 1025 is selectively sealed such that a gas or liquid cannot pass into or from the solution container until a user permits the gas or liquid to pass into or from the solution container.

Greeting card 1000 additionally includes a spring device 1030 having an output gear 1035. Output gear 1035 may be operatively connected to input shaft 1040, which may include a gear portion configured to interact with output gear 1035. Input shaft 1040 is operatively connected to a fan 1045. In another embodiment, spring device 1030 is operatively connected to fan 1045. Fan 1045 is located in substantial proximity to bubble forming substrate 1010 such that an air stream generated by fan 1045 will pass near or through bubble forming substrate 1010 thus creating at least one bubble.

Card 1000 additionally includes a circular gear 1050 operatively connected to tube 1020 and configured to interact with tube 1020. In one embodiment, rotation of circular gear 1050 causes at least one circular gear 1050 to interact with tube 1020, thereby causing bubble solution to flow from solution container 1025, through tube 1020 and into bubble forming substrate 1010.

Card 1000 may additionally include a pull string 1055 operatively connected to spring device 1030. Pull string 1055 may be made of any material, including without limitation, yarn, thread, textile, rope, or cable, or of any of the following: a polymer, a metal, an alloy, or a composite. Pull string 1055 may optionally include a pull handle, which may be made of any material, including without limitation, a polymer, a metal, an alloy, or a composite. In one embodiment, pull string 1055 may be in communication with a seal in solution container 1025, such that pulling string 1055 also breaks the sale in solution container 1025, allowing bubble solution to travel into tube 1020.

Spring device 1030 may include any mechanical energy storage device. In one embodiment, spring device includes a spiral spring configured to be biased in one rotational direction. The spiral spring may be connected to a shaft positioned within the spring. One or more of the shaft and spiral spring may be operatively connected to frame 1005. Pull string 1055 may be attached to the shaft and wrapped around it such that upon pulling pull string 1055, the shaft is rotated in a direction opposite that in which the spiral spring is biased. Upon release of pull string 1055, the spiral spring causes the shaft to rotate in the direction in which the spiral spring is biased. The shaft may be operatively connected to output gear 1035, such that rotation of the shaft causes rotation of output gear 1035.

In one embodiment, a user pulls pull string 1055, causing spring device 1030 to be loaded with mechanical energy. Upon release of pull string 1055, output gear 1035 rotates, causing input shaft 1040 to rotate, which thus causes fan 1045 to rotate. Output gear 1035 additionally causes circular gear 1050 to rotate. Circular gear 1050 is operatively connected to tube 1020, such that rotation of circular gear 1050 causes bubble solution from solution container 1025 to be transferred to bubble forming substrate 1010. An air stream generated by fan 1045 at least substantially contacts bubble forming substrate 1010 so as to create at least one bubble.

Figure 11A:
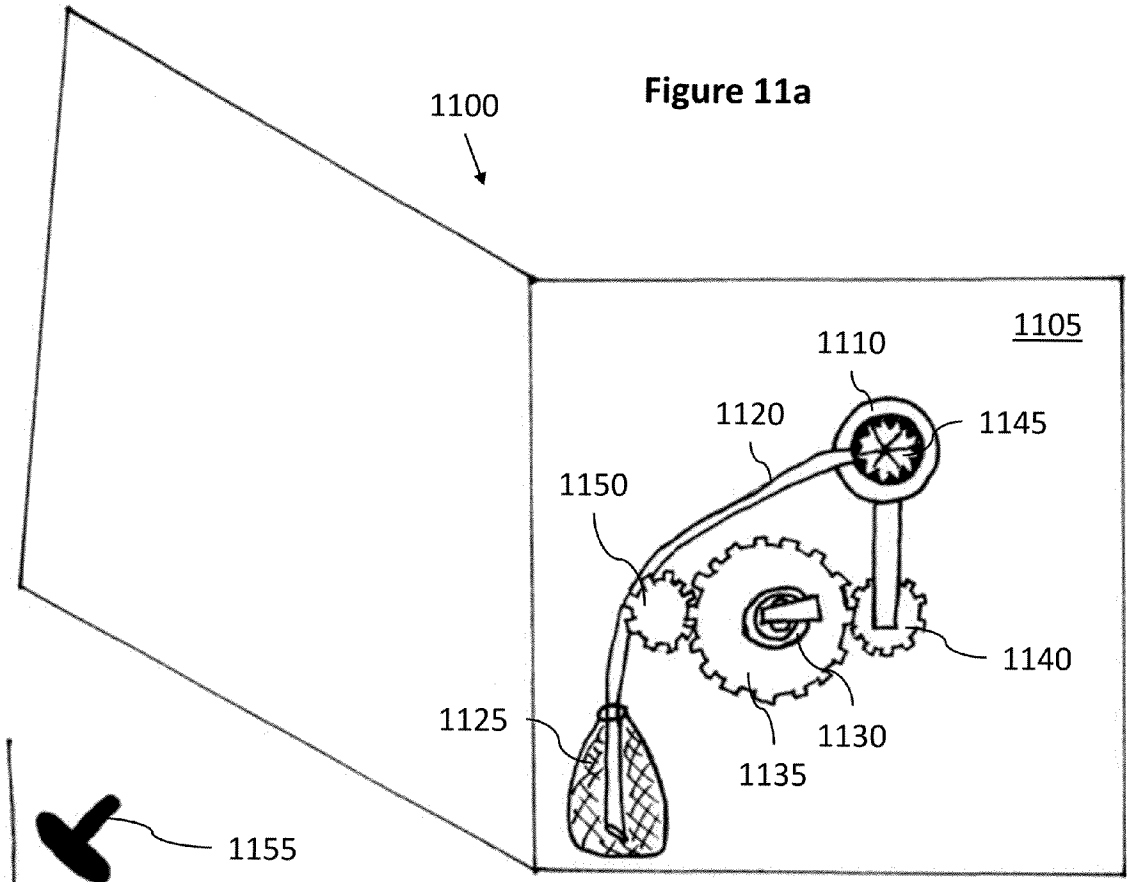
FIG. 11*a* illustrates another example arrangement of a greeting card having an integrated bubble feature.

FIG. 11*a* illustrates another embodiment of an example arrangement of a greeting card having an integrated bubble feature. Greeting card 1100 includes a frame 1105, a bubble forming substrate 1110, and a tube 1120 operatively connected to bubble forming substrate 1110 and a solution container 1125. Tube 1120 may be configured to transport a bubble solution from solution container 1125 to bubble forming substrate 1110.

Greeting card 1100 additionally includes a spring device 1130 having an output gear 1135. Output gear 1135 may be operatively connected to input shaft 1140, which may include a gear portion configured to interact with output gear 1135. Input shaft 1140 is operatively connected to a fan 1145. In another embodiment, spring device 1130 is operatively connected to fan 1145. Fan 1145 is located in substantial proximity to bubble forming substrate 1110 such that an air stream generated by fan 1145 will pass near or through bubble forming substrate 1110 thus creating at least one bubble.

Card 1100 additionally includes a circular gear 1150 operatively connected to tube 1120 and configured to interact with tube 1120. In one embodiment, rotation of circular gear 1150 causes at least one circular gear 1150 to interact with tube 1120, thereby causing bubble solution to flow from solution container 1125, through tube 1120 and into bubble forming substrate 1110.

Figure 11B:
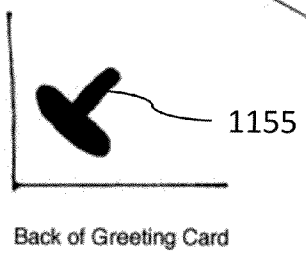
FIG. 11*b* illustrates a crank handle for use in greeting card having an integrated bubble feature.

As illustrated in FIG. 11*b*, card 1100 may additionally include a crank handle 1155 operatively connected to spring device 1130.

In one embodiment, a user rotates crank handle 1155, causing spring device 1130 to be loaded with mechanical energy. Upon release of crank handle 1155, output gear 1135 rotates, causing input shaft 1140 to rotate, which thus causes fan 1145 to rotate. Output gear 1135 additionally causes circular gear 1150 to rotate. Circular gear 1150 is operatively connected to tube 1120, such that rotation of circular gear 1150 causes bubble solution from solution container 1125 to be transferred to bubble forming substrate 1110. An air stream generated by fan 1145 at least substantially contacts bubble forming substrate 1110 so as to create at least one bubble.

In one embodiment (not shown), a greeting card includes a frame, a bubble forming substrate, a tube operatively connected to bubble forming substrate, and a solution container. Tube may be configured to transport a bubble solution from solution container to bubble forming substrate. In one embodiment, the solution container includes a seal to keep bubble solution contained within the solution container, and keep air out of the solution container. A user may squeeze the solution container to cause solution to travel from the tube to the substrate. In another embodiment, the solution container is pressurized at a pressure greater than atmospheric pressure, and includes a seal. A user may squeeze the solution container, causing the seal to break, and bubble solution may be forced out of the solution container and into the tube to the bubble forming substrate. In one embodiment, the tube may be eliminated, such that the solution container directs bubble solution to the bubble forming substrate directly. In another embodiment, the bubble forming substrate is directly connected to the solution container.

In one embodiment, an air container is also provided. The air container may be a pressurized container holding air that is at a pressure greater than atmospheric pressure. The air container may comprise a seal configured to keep air within the air container. In one embodiment, a user may squeeze the air container, causing the seal to break and causing air to travel out of the container. In another embodiment, a user may pull a string attached to the air container, which will cause the seal to break and air to travel out of the container. In one embodiment, air from the air container propels bubble solution out of the solution container. In one embodiment, the air container is configured to supply air to the bubble forming substrate. In one embodiment, the air container is contained within the solution container. In another embodiment, the air container is separate from the solution container.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. Finally, where the term "about" is used in conjunction with a number, it is intended to include ±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, illustrative examples shown, or any apparatus referred to. Departures may be made from such details, examples, and apparatuses without departing from the spirit or scope of the general inventive concept.

What is claimed is:

1. A greeting card having an integrated bubble feature, comprising:

a frame, wherein the frame is at least one of a greeting card and a portion of a greeting card, and wherein the frame comprises a cover;

an energy storage device operatively connected to the frame;

a switch mechanism operatively connected to the frame, wherein the switch mechanism is activated upon at least one of a user manipulating the cover, a user manipulating a switch, and exposure to a light source;

a motor operatively connected to each of the frame, the energy storage device, and the switch mechanism;

a fan operatively connected to the frame and the motor; and a bubble forming substrate operatively connected to the frame.

2. The card of claim 1, further comprising a tube configured to transport a bubble solution.

3. The card of claim 2, further comprising at least one pressure clasp operatively connected to the tube.

4. The card of claim 2, further comprising at least one circular gear operatively connected to the tube.

5. The card of claim 1, further comprising a solution container.

6. The card of claim 1, further comprising an air shaft operatively connected to each of the fan and the bubble forming substrate.

7. The card of claim 1, further comprising a bubble solution.

8. The card of claim 1, further comprising an arm member operatively connected to each of the bubble forming substrate and the frame.

9. The card of claim 1, further comprising a circuit board operatively connected to each of the energy storage device, the switch mechanism, and the motor.

10. A greeting card with an integrated bubble feature, comprising:

a frame, wherein the frame is at least one of a greeting card and a portion of a greeting card, and wherein the frame comprises a cover;

a tube operatively connected to the frame, the tube configured to transport a bubble solution;

a solution container operatively connected to the frame;

a bubble forming substrate operatively connected to the frame;

an energy storage device operatively connected to the frame;

a switch mechanism operatively connected to the frame, wherein the switch mechanism is activated upon at least one of a user manipulating the cover, a user manipulating a switch, and exposure to a light source;

a motor operatively connected to each of the frame, the energy storage device, and the switch mechanism; and a fan operatively connected to the frame and the motor.

11. The card of claim 10, wherein the frame comprises an aperture operatively connected to the bubble forming substrate.

12. The card of claim 10, further comprising a bubble solution.

13. The card of claim 10, wherein the solution container comprises a pliable structure configured to allow a user to compress the solution container.

14. A greeting card with an integrated bubble feature, comprising:

a frame, wherein the frame is at least one of a greeting card and a portion of a greeting card, and wherein the frame comprises a cover;

a tube operatively connected to the frame, the tube configured to transport a bubble solution;

a fan operatively connected to the frame;

a bubble forming substrate operatively connected to the frame;

a solution container operatively connected to the frame; and a spring device operatively connected to the frame, the spring device having an output gear, wherein the output gear is operatively connected to an input shaft, wherein the input shaft includes a gear configured to interact with the output gear, and wherein the input shaft is connected to the fan.

15. The card of claim 14, further comprising at least one circular gear operatively connected to the tube.

16. The card of claim 14, further comprising a pull string operatively connected to the spring device.

17. The card of claim 14, further comprising a crank operatively connected to the spring device.

18. The card of claim 14, further comprising a bubble solution.

19. The card of claim 14, wherein the solution container is selectively sealed such that a gas or liquid cannot pass into or from the solution container until a user permits the gas or liquid to pass into or from the solution container.

* * * * *